US008388463B2

(12) United States Patent
Turner et al.

(10) Patent No.: US 8,388,463 B2
(45) Date of Patent: Mar. 5, 2013

(54) GOLF PUTTING TRAINER

(76) Inventors: Joshua M. Turner, Valparaiso, IN (US); Thomas J. Turner, Greenfield, IN (US)

( * ) Notice: Subject to any disclaimer, the term of this patent is extended or adjusted under 35 U.S.C. 154(b) by 0 days.

(21) Appl. No.: 13/165,028

(22) Filed: Jun. 21, 2011

(65) Prior Publication Data

US 2012/0329569 A1 Dec. 27, 2012

(51) Int. Cl.
*A63B 69/36* (2006.01)

(52) U.S. Cl. ..... 473/280; 473/409

(58) Field of Classification Search ..... 473/198, 473/200, 280, 569, 409
See application file for complete search history.

(56) References Cited

U.S. PATENT DOCUMENTS 3,357,705 A * 12/1967 Blanchard ..... 473/280
3,918,720 A 11/1975 Gordos
4,278,254 A 7/1981 Simjian
4,402,511 A 9/1983 Simjian
4,441,716 A 4/1984 Chen
4,494,757 A 1/1985 Simjian
5,431,391 A 7/1995 Tracey
5,885,165 A 3/1999 Krause
6,004,220 A 12/1999 Razzano
6,129,639 A 10/2000 Brock
6,511,384 B1 1/2003 Villacorta
7,112,146 B2 9/2006 Bennett
7,160,201 B2 1/2007 Dahl
7,207,895 B2 4/2007 Canakes
7,214,146 B1 5/2007 Gersang
7,407,165 B1 * 8/2008 Chisnell ..... 277/603
7,819,762 B2 10/2010 Bernal-Silva et al.
2007/0011805 A1 * 1/2007 Shien ..... 4/615

* cited by examiner

*Primary Examiner* — Nini Legesse
(74) *Attorney, Agent, or Firm* — Ryan O. White; Taft Stettinius & Hollister, LLP

(57) ABSTRACT

A golf training device comprising a cylindrical body having a proximal end and a distal end, a groove formed in the cylindrical body, and a roll ring configured to circumscribe the cylindrical body by releasably engaging the groove.

14 Claims, 4 Drawing Sheets

GOLF PUTTING TRAINER

TECHNICAL FIELD

The present invention generally relates to a golf putting device and more specifically, to a putting device that teaches and trains a golfer to square and line their putter face with a desired target path during a putting stroke.

BACKGROUND OF THE INVENTION

There are many golf training devices and aids on the market, each designed to improve one or more aspects of a golfer's game. Some of the devices assist the golfer with proper alignment and ball positioning, while others attempt to help the golfer achieve better (square) contact with the golf ball. Unfortunately, many of these training devices have moving parts, require assembly or don't fit easily into a standard golf bag. As such, many of these training aids are impractical and inconvenient to use.

There is a need for a golf training device that is convenient and practical for golfers of all skill levels to use. The present invention is intended to improve upon and resolve some of these known deficiencies.

SUMMARY OF THE INVENTION

In accordance with one aspect of the present invention, a putting device that teaches and trains a golfer to square and line their putter face with a desired target path during a putting stroke is provided. To accomplish this, the device reflects miss-struck putting attempts by either tracking off-line to the right or left of the desired path, as well as reflects correctly-struck putting attempts by rolling in-line with the desired path to the target.

In accordance with another aspect of the present invention, a golf training device is provided. This device comprises a cylindrical body having a proximal end and a distal end, a groove formed in the cylindrical body, and a roll ring configured to circumscribe the cylindrical body by releasably engaging the groove.

In accordance with still another aspect of the present invention, the golf training device comprises a cylindrical body formed from a thermoplastic polymer and having a proximal end and a distal end, a series of grooves formed in the cylindrical body, and at least four roll rings, each ring configured to circumscribe the cylindrical body by releasably engaging one of the series of grooves.

In accordance with yet another aspect of the present invention, a method for training a golfer to recognize when their putter face is square in line with a desired target path during a putting stroke is provided. In accordance with this embodiment, the method comprises placing a cylindrical training device on the ground at a first location relative to a golfer's stance; striking the device with a putter to cause it to travel in the direction of a target; observing whether the device travels substantially along an intended path as it advances towards the target; repositioning the device on the ground at a second location relative to the golfer's stance if the device fails to travel substantially along the intended path; re-striking the device with the putter to cause it to once again travel in the direction of the target; observing whether the device travels substantially along the intended path as it advances towards the target; and repeating the steps of repositioning, re-striking and observing the device until it travels substantially along the intended path.

Other objects and benefits of the invention will become apparent from the following written description along with the accompanying figures.

BRIEF DESCRIPTION OF THE DRAWINGS

The above-mentioned aspects of the present invention and the manner of obtaining them will become more apparent and the invention itself will be better understood by reference to the following description of the embodiments of the invention taken in conjunction with the accompanying drawings, wherein.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Unless defined otherwise, all technical and scientific terms used herein have the same meaning as commonly understood by one of ordinary skill in the art to which this invention belongs. Although any method and materials similar or equivalent to those described herein can be used in the practice or testing of the present invention, the specific methods and materials are now described. Moreover, the techniques employed or contemplated herein are standard methodologies well known to one of ordinary skill in the art and the materials, methods and examples are illustrative only and not intended to be limiting.

Figure 1:
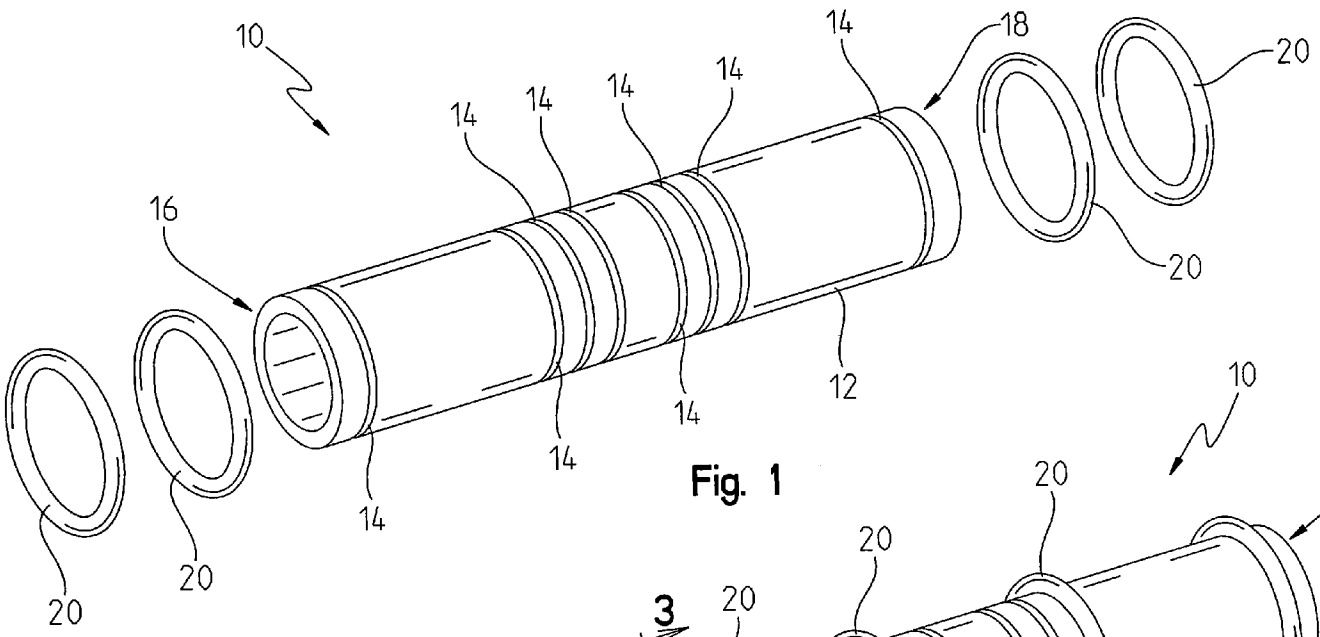
FIG. 1 is an exploded view of a putting device and roll rings in accordance with the teachings of the present invention.
Figure 2:
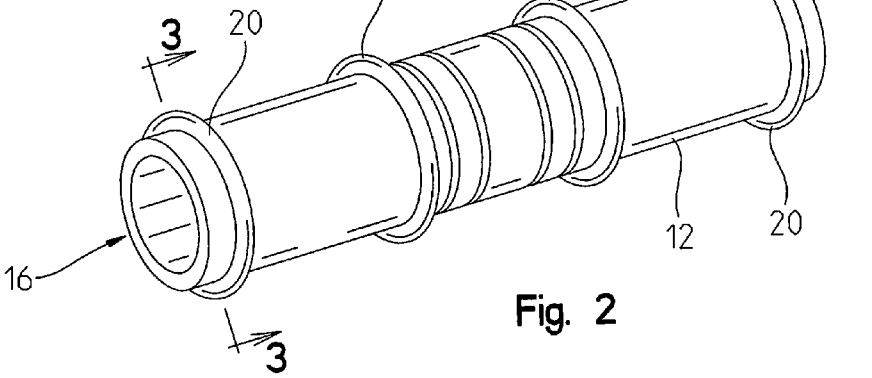
FIG. 2 is a perspective view of a putting device in accordance with the teachings of the present invention.
Figure 3:
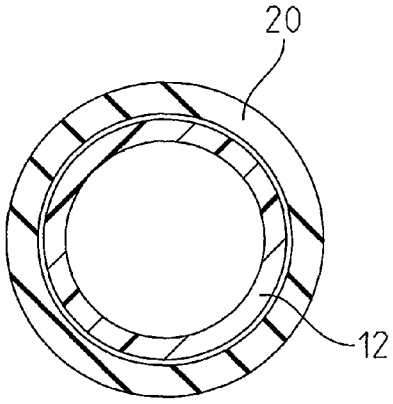
FIG. 3 is an end view of a putting device in accordance with the teachings of the present invention.
Figure 4:
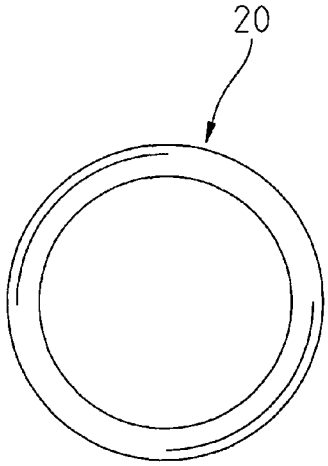
FIG. 4 is a roll ring for a use with a putting device in accordance with the teachings of the present invention.

The following detailed description, beginning with FIG. 1, illustrates a golf training device for putting 10. In accordance with one aspect of the present invention, the training device 10 has a cylindrical or tubular body 12, a proximal end 16, a distal end 18 and a series of grooves or retaining rings 14 that are spatially etched or cut into the body 12 of the training device 10. In accordance with certain embodiments, the body 12 is hollow and has openings at its proximal and distal ends 16, 18. As shown in FIGS. 2 and 3, the retaining rings 14 are designed to securely, yet releasably, hold a roll ring 20 (see also FIG. 4) that has been circumferentially placed over the body 12 of the training device 10 and positioned at one of their respective locations. While it should be understood and appreciated herein that various spatial and numerical combinations of roll rings 20 can be used with the training device 10 to achieve varying levels of difficulty in accordance with the present invention, in certain embodiments, four (4) roll rings 20 are used with the training device 10. Moreover, in accordance with these specific embodiments, two (2) of these roll rings 20 are respectively positioned at the location of the retaining ring 14 immediately adjacent and closest to the proximal and distal ends 16, 18 (i.e., positions 14*a* and 14*h* of FIG. 5). As will be explained in more detail below, the remaining two roll rings 20 can be positioned at various different spatial configurations within the inner section of retaining rings (i.e., rings 14*b*, 14*c*, 14*d*, 14*e*, 14*f* and 14*g* of FIG. 5) to adjust the difficulty associated with using the device if desired by the user.

In accordance with other embodiments of the present invention, the two (2) roll rings 20 that can be respectively positioned at the location of the retaining rings 14 immediately adjacent and closest to the proximal and distal ends 16, 18 (i.e., positions 14*a* and 14*h* of FIG. 5) of the device are removed. In accordance with these specific embodiments, the user is able to more effectively play the slope of a putting service by using only two roll rings 20 that have been respectively placed at one of the various retaining ring locations within the inner section of device (i.e., rings 14*b*, 14*c*, 14*d*, 14*e*, 14*f* and 14*g* of FIG. 5).

Figure 5:
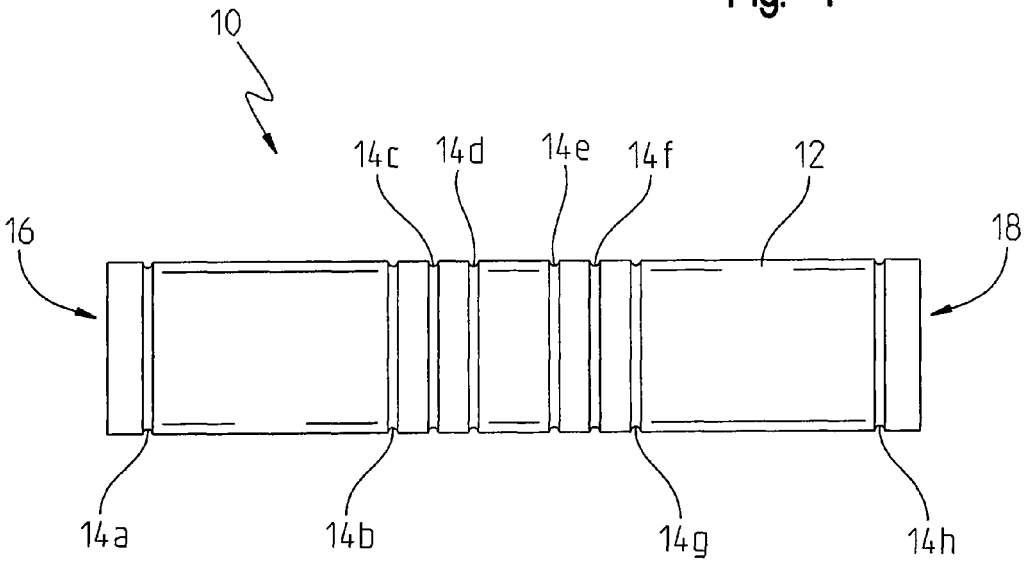
FIG. 5 is a side view of a putting device in accordance with the teachings of the present invention.

Referring now to FIG. 5, in accordance with certain aspects of the present invention, the training device 10 has eight retaining rings 14 spatially positioned at various locations along the length of its body 12 (shown here as 14*a*, 14*b*, 14*c*, 14*d*, 14*e*, 14*f*, 14*g*, 14*h*). In accordance with specific embodiments, the training device 10 has a length between about 4.0 and about 6.0 inches, more specifically about 5.0 inches. The diameter, in accordance with specific embodiments, is between about 0.90 and 1.5 inches, more specifically about 1.0625 inches. In accordance with one specific embodiment of the present invention, the retaining rings 14*a*, 14*b*, 14*c*, 14*d*, 14*e*, 14*f*, 14*g*, 14*h* are positioned approximately 0.25, 1.75, 2.00, 2.25, 2.75, 3,00, 3.25 and 4.75 inches respectively from the proximal end 16 of the training device 10. While these retaining rings 14 must be wide enough to securely hold a roll ring 20 that has been fitted therein, in accordance with certain embodiments, the retaining rings 14 each have a width of approximately 1 mm. In turn, the roll rings 20 must have a diameter sufficient enough to snuggly fit over either the proximal 16 or distal end 18 of the training device 10 and advanced along its body 12 until it is positioned inside one of the retaining rings (14*a*, 14*b*, 14*c*, 14*d*, 14*e*, 14*f*, 14*g*, 14*h*). In certain embodiments, the roll rings 20 have a diameter of about 1.25 inches and a width of about 3 mm.

While it should be understood and appreciated herein that those of skill in the art can adjust the specific dimensions of the training device 10 without straying from the teachings of the present invention, it is desirable to have the weight of the device substantially the same as a regulation golf ball (i.e., a weight about and not greater than 1.62 oz (45.93 g)), particularly so that the user feels as if he or she is striking a golf ball when using the device. It should also be understood and appreciated herein that the training device 10 can be manufactured of any material capable of being formed into a cylindrical or tubular shape, including, but not limited to, rubber, plastic, wood and metal. In accordance with specific embodiments, the training device 10 is manufactured from a thermoplastic polymer, such as polyvinyl chloride (PVC). Similarly, it should also be understood that the roll rings 20 can be manufactured from various materials, however, in accordance with certain embodiments the chosen material has the property of elasticity so that its diameter can be stretched to allow the ring to fit over the body 12 of the training device 10, yet configured to return to its original form and thereby conform to the body 12 of the device once it is no longer subjected to physical stress. In accordance with this specific embodiment, the roll rings 20 are manufactured from an elastomeric or thermoplastic material such as rubber.

Figure 6:
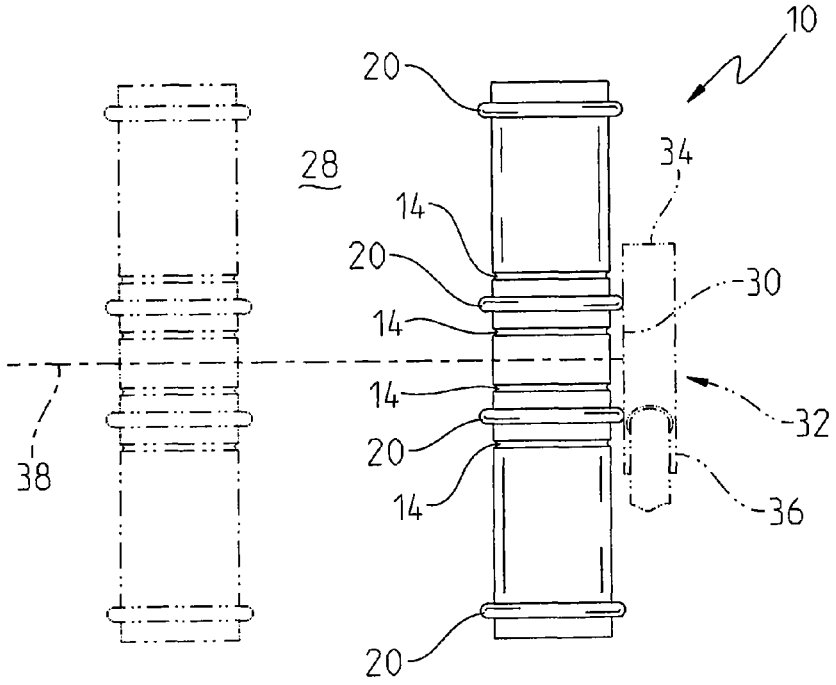
FIG. 6 is a top view of a putting device that has been squarely struck by a putter in accordance with the teachings of the present invention.
Figure 7:
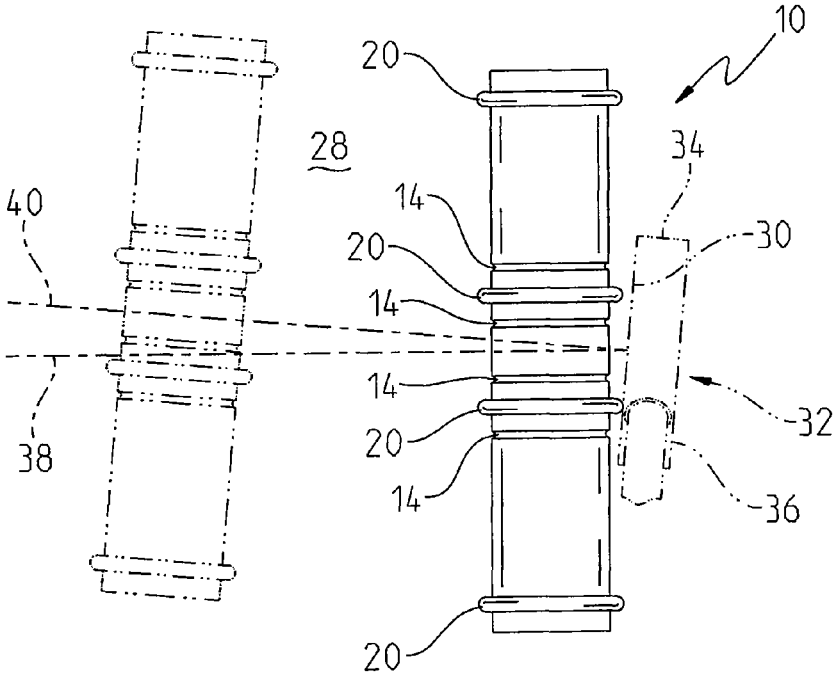
FIG. 7 is a top view of a putting device that has been mis-struck by a putter in accordance with the teachings of the present invention.

During use, and with specific reference to FIGS. 6 and 7, the golfer places the training device 10 on the floor or on a putting green 28. Using a natural putting stroke or style best suited for the user, the golfer contacts the training device 10 with the face 30 of a putter 32. As those of skill in the golfing art will appreciate, a putter has a toe section 34 at its front end and a heal section 36 at its rear end. For right-handed golfers, if the toe section 34 gets ahead of the heal section 36 of the putter 32 when the golfer strikes a golf ball, the ball is going to start off to the left. In contrast, if the heal section 36 is ahead of the toe section 34 of the putter 32 when the golfer makes contact with a golf ball, the ball is going to start off to the right. If a golfer places the golf ball in the center of his or her stance when lining up to putt, the golfer expects the putter face to be square when contact is made with the golf ball. The present inventors have found, however, that often times the putter face 30 is not yet square at this point, particularly as many golfers tend to lean to one side or the other when putting. The present invention is intended to help the golfer determine whether the putter face 30 is properly squaring up to the target line 38 when the putter 32 makes contact with a golf ball.

Typically, when a golfer takes their putter 32 back as part of their backswing, the putter face 30 opens. When the golfer proceeds from this position, the putter face 30 then closes. The putter face 30 gets to a square position (i.e., the position where a golfer wants the ball to sit when putting) at some point along this swing path before it closes. If the ball is in any other location in the stance the ball is sent spinning off line (see line 40 in FIG. 6). Depending on how the putter face 30 contacts the ball, the ball will leave the putter face either spinning (sideways) in one direction or another. If the golfer is able to strike the ball when the putter 32 is in the square position, however, the ball will more accurately travel along its target line 38 as intended.

In accordance with one illustrative example, a right-handed golfer places the training device 10 on the ground or a putting surface 28 and strikes the device 10 with the face 30 of the putter 32 using the golfer's natural swing. If the training device 10 consistently travels to the right after 4 or 5 tries (see FIG. 7) then the golfer should line up with their golf ball further left in their stance. In essence, the training device 10 is telling the golfer that the heal section 36 of their putter 32 is getting to the contact area with the golf ball first. To correct this situation, the golfer should move the training device 10 a small amount (e.g., about one half an inch) to the left in their stance. With this new position, the golfer should try 4 or 5 more strokes. If the direction is not corrected, the golfer should move the training device 10 more to the left in their stance. Simply put, the golfer is trying to find a way to give their putter 32 more time during the stroke to get to the square position and thus properly aligned with the golf ball when making impact. Once again, every golfer has a point in their putting stroke where the putter 32 is square to the target line 38. The main goal is to find that spot in the golfer's putting stroke so that the putter 32 is square to the target line 38 the golfer wants the golf ball to travel.

Figure 8:
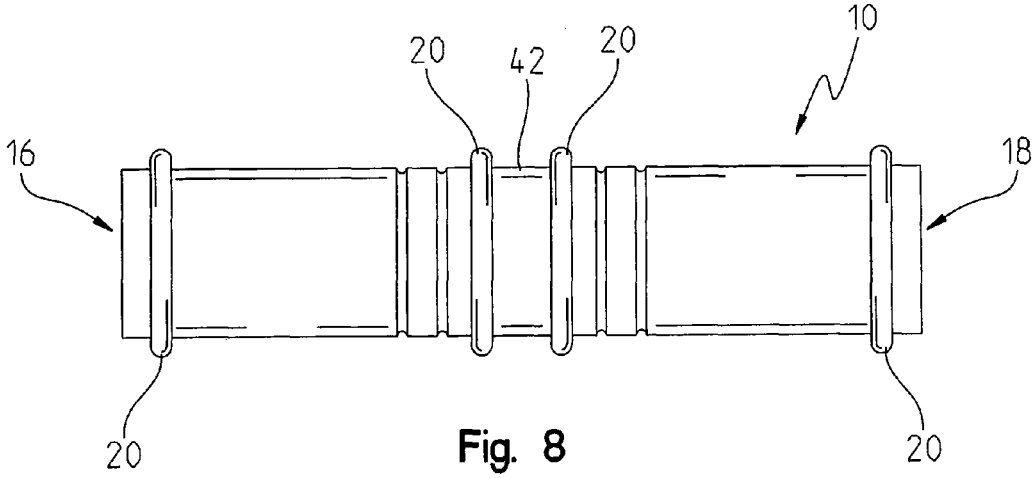
FIGS. 8-10 are side views of putting devices in accordance with the teachings of the present invention, each putting device having its respective roll rings in a different spatial configuration.
Figure 9:
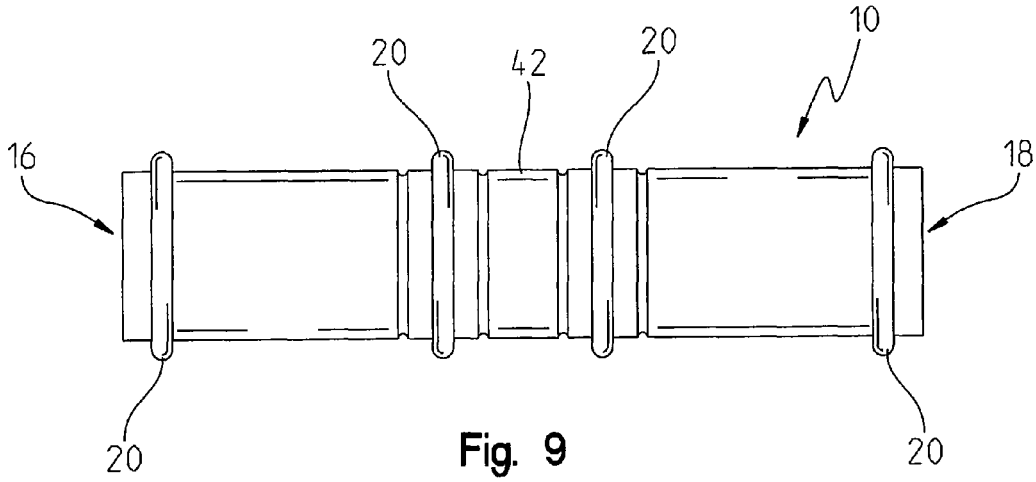
Figure 10:
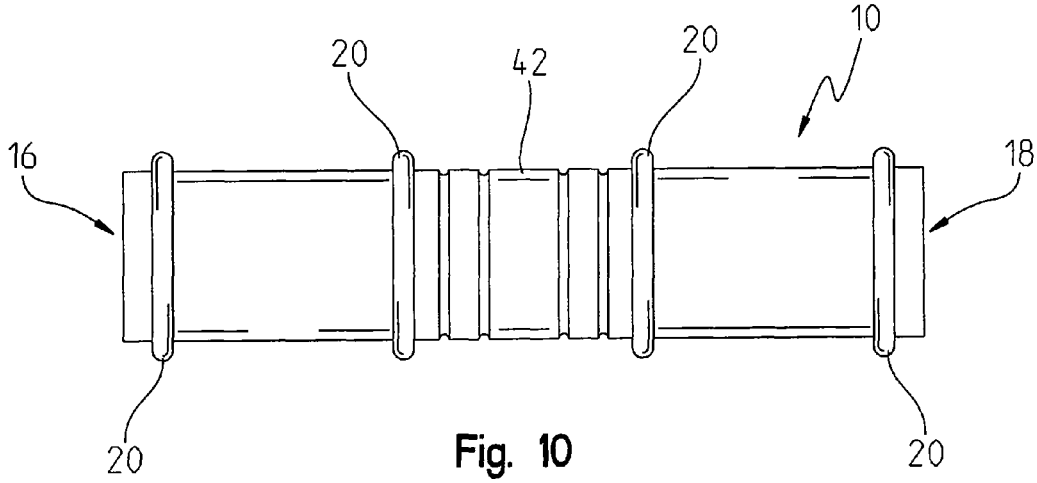

With reference now to FIGS. 8-10, and in accordance with certain aspects of the present invention, the level of difficulty associated with the training device 10 can be adjusted by moving the roll rings 20 to different retaining ring 14 locations or grooves along the training device. For instance, moving the two roll rings 20 centrally positioned in FIG. 8 one retaining ring 14 location respectively away from the center 42 of the training device 10 (see FIG. 9) will increase feedback and accuracy of each putting stroke. Essentially, respectively moving the two inner roll rings 20 further from the center 42 of the training device will increase the difficulty associated with using the device. Said differently, with the center roll rings 20 positioned at the innermost set of grooves or retaining rings 14 (FIG. 8), the contact point is narrowed and thus less sensitive to miss-struck or off square putting strokes. The device 10 will also roll off-line after struck in a less sever manner.

With the center roll rings 20 positioned in the middle set of grooves or retaining rings 14 (see FIG. 9), the contact points are farther apart, thereby making square contact more difficult to achieve. The device 10 will indicate miss-stuck or off square putting strokes more severely by rolling right or left of the intended target line in an exaggerated fashion compared to the narrow setting.

With the center roll rings 20 positioned at the outermost set of grooves (FIG. 10), the contact points are extended further making square contact sensitivity at the highest level. This difficulty level causes the contact points of the putter face to be approximately the diameter of a standard golf ball apart.

While an exemplary embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A golf training device, the device consisting:

a hollow cylindrical body having a proximal end and a distal end, the cylindrical body defining an unobstructed through-hole between the proximal and distal ends;

a groove formed in the cylindrical body; and a roll ring configured to circumscribe the cylindrical body by releasably engaging the groove;

wherein the device has a weight not greater than 1.62 oz.

2. The golf training device of claim 1, wherein the cylindrical body is formed from a material selected from rubber, plastic, wood and metal.

3. The golf training device of claim 1, wherein the cylindrical body is formed from a thermoplastic polymer.

4. The golf training device of claim 3, wherein the thermoplastic polymer is polyvinyl chloride.

5. The golf training device of claim 1, wherein the roll ring is formed from an elastomeric or thermoplastic material.

6. The golf training device of claim 5, wherein the roll ring is formed from rubber.

7. A golf training device, the device consisting:

a hollow cylindrical body formed from a thermoplastic polymer and having a proximal end and a distal end, the cylindrical body defining an unobstructed through-hole between the proximal and distal ends;

a series of grooves formed in the cylindrical body; and at least four roll rings, each ring configured to circumscribe the cylindrical body by releasably engaging one of the series of grooves;

wherein the device has a weight not greater than 1.62 oz.

8. The golf training device of claim 7, wherein the thermoplastic polymer is polyvinyl chloride.

9. The golf training device of claim 7, wherein the roll rings are each formed from an elastomeric or thermoplastic material.

10. The golf training device of claim 9, wherein the roll rings are each formed from rubber.

11. A method for training a golfer to recognize when their putter face is square in line with a desired target path during a putting stroke, the method comprising:

placing a hollow cylindrical training device having a proximal end and a distal end on the ground at a first location relative to a golfer's stance, the cylindrical training device having a weight not greater than 1.62 oz and defining an unobstructed through-hole between the proximal and distal ends;

striking the device with a putter to cause it to travel in the direction of a target;

observing whether the device travels substantially along an intended path as it advances towards the target;

repositioning the device on the ground at a second location relative to the golfer's stance if the device fails to travel substantially along the intended path;

re-striking the device with the putter to cause it to once again travel in the direction of the target;

observing whether the device travels substantially along the intended path as it advances towards the target; and repeating the steps of repositioning, re-striking and observing the device until it travels substantially along the intended path.

12. The method of claim 11, wherein the step of placing the device on the ground at a first location relative to a golfer's stance comprises placing the device substantially near the center of the golfer's stance.

13. The method of claim 11, wherein the step of repositioning the device on the ground at the second location relative to the golfer's stance comprises placing the device on the ground about one half an inch to the right or left of the first location.

14. The method of claim 11, wherein the step of striking the device with the putter to cause it to travel in the direction of the target comprises striking the device with a putter face.

* * * * *